US007048414B2

(12) United States Patent
Weber

(10) Patent No.: US 7,048,414 B2
(45) Date of Patent: May 23, 2006

(54) LIGHT FIXTURE COVER SYSTEM AND METHOD

(76) Inventor: Martin Thomas Weber, 909 Wentwood Dr., Southlake, TX (US) 76092-8688

( * ) Notice: Subject to any disclaimer, the term of this patent is extended or adjusted under 35 U.S.C. 154(b) by 269 days.

(21) Appl. No.: 10/612,536

(22) Filed: Jul. 2, 2003

(65) Prior Publication Data

US 2004/0201996 A1 Oct. 14, 2004

Related U.S. Application Data

(60) Provisional application No. 60/462,006, filed on Apr. 11, 2003.

(51) Int. Cl.
*F21K 29/00* (2006.01)

(52) U.S. Cl. ..... 362/267; 362/293; 362/374; 362/375; 362/510

(58) Field of Classification Search ..... 362/278, 362/310, 311, 320, 374–376, 510, 389
See application file for complete search history.

(56) References Cited

U.S. PATENT DOCUMENTS 3,696,238 A * 10/1972 Szymanski ..... 362/293
3,974,373 A 8/1976 Zapolsky
D247,520 S 3/1978 Hazerjian et al.
D248,186 S 6/1978 Hazerjian et al.
4,099,224 A 7/1978 Valpey
4,104,712 A 8/1978 Hafner
D250,218 S 11/1978 Hazerjian et al.
4,164,009 A 8/1979 Maguire, Jr. et al.
D253,015 S 9/1979 Hazerjian et al.
4,271,408 A 6/1981 Teshima et al.
4,295,675 A 10/1981 Niskin
4,323,954 A * 4/1982 Florence et al. ..... 362/311
4,323,955 A 4/1982 Mark
4,410,931 A 10/1983 DeCandia et al.
4,520,435 A 5/1985 Baldwin
4,574,338 A 3/1986 Takasaki et al.
4,667,278 A 5/1987 Poyer
4,825,346 A 4/1989 Schindler et al.
4,931,915 A 6/1990 Quiogue
5,025,358 A 6/1991 Cannell
5,143,443 A 9/1992 Madsen
5,143,446 A 9/1992 Barnes et al.
5,144,540 A 9/1992 Hayes
5,156,454 A 10/1992 White
5,161,880 A 11/1992 Azuma
5,176,441 A 1/1993 Horvath dr.nee Vegh et al.
5,221,140 A 6/1993 Oshino
5,222,802 A 6/1993 Beck
5,226,721 A 7/1993 Stokes
5,263,788 A 11/1993 Moriel
5,272,603 A 12/1993 Camarota et al.
5,297,013 A 3/1994 Hall et al.
5,309,341 A 5/1994 Russello et al.

(Continued)

*Primary Examiner*—Stephen F Husar
(74) *Attorney, Agent, or Firm*—Kevin Mark Klughart

(57) ABSTRACT

A light fixture cover system and method is disclosed in which the selectively detachable cover is also a unitary structure including a body having a peripheral sealing lip that fits over any corresponding industry standard outside light fixture. The sealing lip of the cover has at least one laterally extending tab member to assist in removing the cover from the fixture. The cover portion is preferably made from a resilient polymeric material suitable for both winter and summer weather conditions in addition to being impervious to the heat generated by the electrical bulb or bulbs contained it the light fixture.

21 Claims, 10 Drawing Sheets

U.S. PATENT DOCUMENTS

| | | | |
|---|---|---|---|
| 5,309,342 | A | 5/1994 | Heinen, Sr. |
| 5,349,510 | A | 9/1994 | Jordan et al. |
| 5,359,506 | A | 10/1994 | Koleno |
| 5,394,316 | A | 2/1995 | Holbrook et al. |
| 5,404,279 | A | 4/1995 | Wood |
| 5,406,466 | A | 4/1995 | Stokes |
| 5,477,441 | A | 12/1995 | Budnovitch et al. |
| 5,491,618 | A | 2/1996 | Vakil |
| 5,499,174 | A | 3/1996 | Lin |
| 5,517,394 | A | 5/1996 | Lin |
| D372,325 | S | 7/1996 | Hackworth |
| 5,536,019 | A | 7/1996 | Bryant et al. |
| 5,567,045 | A | 10/1996 | Bucek |
| D376,222 | S | 12/1996 | Jameson, Jr. |
| 5,651,606 | A | 7/1997 | Krogman |
| 5,738,437 | A | 4/1998 | Ilagan |
| 5,743,622 | A | 4/1998 | Ibbitson et al. |
| 5,850,999 | A | 12/1998 | Gross |
| 5,918,966 | A | 7/1999 | Arnold |
| 5,951,148 | A | 9/1999 | Limber |
| 5,957,568 | A | 9/1999 | Byers |
| 6,032,827 | A | 3/2000 | Zettle et al. |
| 6,155,695 | A | 12/2000 | Sealy |
| D437,429 | S | 2/2001 | Boessel |
| 6,198,220 | B1 | 3/2001 | Jones et al. |
| 6,312,145 | B1 | 11/2001 | Rhoad |
| 6,456,437 | B1 | 9/2002 | Lea et al. |
| 6,461,736 | B1 | 10/2002 | Nagashima et al. |
| 6,481,873 | B1 | 11/2002 | Smith |
| 6,481,875 | B1 | 11/2002 | Bryant |
| 6,502,962 | B1 | 1/2003 | Menke et al. |

* cited by examiner

*Prior Art*

LIGHT FIXTURE COVER SYSTEM AND METHOD

CROSS REFERENCE TO RELATED APPLICATIONS

Applicant claims benefit pursuant to 35 U.S.C. § 119 and hereby incorporates by reference Provisional Patent Application for "LIGHT FIXTURE COVER SYSTEM AND METHOD", Ser. No. 60/462,006, filed Apr. 11, 2003, and submitted to the USPTO with Express Mail on Apr. 11, 2003 with tracking number EU828406878US.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention relates generally to electrical illumination, and more specifically to a cover and an attachment means for an external light fixture wherein the cover is provided with a peripheral sealing lip that has a horizontal U-shape channel which allows for a hand press fit attachment for ease of mating components and a tab for ease of disengaging the cover from the fixture. This attachment configuration provides numerous advantages over the conventional radial screws that capture a lip of the fixture cover and more recently the circumferential helical channel and flange system. The present attachment is more secure and provides a better seal, serving to keep out insects and water while requiring no tools or other equipment for the removal and replacement of the light fixture cover.

DESCRIPTION OF THE PRIOR ART (0100)

Overview

It has long been recognized that a light source requires some form of protection. This understanding extends back to lights provided by open flame (lanterns, etc.), where transparent or translucent enclosures were developed to protect other articles from the open flame, and to prevent the flame from being blown out by a draft or gust of wind. Typically, such covers were constructed in a three dimensional polygonal form, with flat poured glass panels set in a supporting frame of some sort. Examples of this construction are illustrated in FIG. 1 (0101, 0102). A variety of other structural forms implementing this protective mechanism have also been taught by the prior art, as illustrated in FIG. 1 (0103, 0104, 0105).

Accordingly, a plurality (generally three) of radially disposed screws were provided through the base, which would engage the base of the cover frame to secure the two components together where required. It will be noted that often no attachment means at all was provided, as such open flame lighting required that the fixture and cover be oriented with the cover above the fixture base. Gravity would suffice to secure the cover atop the underlying fixture base for such lights, where it was unlikely that the cover would be inadvertently dislodged.

Shortly after the development of the incandescent electric light, it was realized that the light bulb itself, with its high heat output, fragile filament, and near vacuum enclosure, also required some protection from the elements in order to prolong its life span. Accordingly, various transparent and translucent covers, globes, and the like were developed, as illustrated in FIG. 1. However, with the ability of the electric light to be mounted in any orientation, some means of removably attaching a depending fixture cover from an overhead fixture base was needed, and the same attachment means that was already known for earlier lighting principles, was used. Other attachment means (clips, etc.) were developed which also did not require the cover to be turned relative to the base, in order to provide for universal attachment for circular, oblong, or non-circular covers.

These light fixture covers generally have an outward flange extending completely around their bases, with the fixture having perhaps three or four threaded holes spaced about its periphery, as exemplified by FIG. 1 (0104). Small screws are threaded into the holes and tightened, extending beneath the lip of the cover to preclude its removal from the fixture base. This fastening system is essentially the same system developed in the distant past, to secure a polygonal lantern cover having multiple panes to its underlying base, even though the vast majority of modern lighting fixtures include circular covers.

The above-described means of securing a light fixture cover to a fixture base is serviceable, but has many disadvantages. Many such fixtures require a small screwdriver or other tool to turn the screws. Also, it is awkward to remove and reattach the cover from an overhead fixture, while trying to access the screws from around the sides of the fixture, which often has a larger diameter than its base. When the cover is secured, a gap will remain between the cover and fixture, allowing insects and such to enter the fixture. The small screws are easily cross threaded, resulting in resistance which feels as though the screw has been driven home, when actually no grip is being provided by the cross threaded screw. A fixture using only three screws for securing the fixture cover results in the inability to secure the entire fixture cover when a single screw is lost, which can easily occur. The outwardly extending lip of such fixture covers invites misalignment, with the screw perhaps passing over, or into the edge of, the lip, again resulting in the loss of security by that screw and inability to secure the cover.

Additionally, external light fixtures have been so designed as to integrate a glass clear or opaque jar shaped cover that must screw into the fixture and is fixture specific for replacement. This approach only works for certain types and designs of external light fixtures and at a significant cost compared to the current invention.

Perhaps as a result of the above described deficiencies of the conventional light fixture cover attachment means, other attachment means have been developed (e.g., clips, etc.), as will be noted in the discussion of the prior art following. However, to the knowledge of the present inventor, no one has developed a selectively detachable cover that is also a unitary structure including a body having a peripheral sealing lip to secure a light fixture cover to its corresponding light fixture. Additionally, no one has developed a cover with a removing tab and a waterproof surface in this economic range. A discussion of the prior art known to the present inventor, with its distinctions from the present invention, is provided immediately below.

U.S. Pat. No. 3,974,373

U.S. Pat. No. 3,974,373 issued on Aug. 10, 1976 to Ira M. Zapolsky describes a LAMP FIXTURE having a specially formed base and cover. The cover is generally conventional, having an outwardly extending flange around the base thereof. The fixture base provides multiple locations for the mounting of a pair of opposed clips, which extend into the interior of the cover. Accordingly, the cover must have a larger internal diameter immediately within it's opening, into which the clips may expand to secure the cover to the fixture base. Moreover, in at least one embodiment, Zapolsky specifically provides for the base of the cover to be spaced away from the interior of the fixture base. While the side of the fixture cover is adapted to fit closely against the fixture base wall, any looseness of the clips would result in a path for insects, etc. to enter the fixture cover. If a single clip is broken or lost, the cover cannot be replaced on the fixture base. The present invention overcomes these problems.

U.S. Pat. No. 4,099,224

U.S. Pat. No. 4,099,224 issued on Jul. 4, 1978 to Lucy L. Valpey describes a SNAP ON CONNECTION AND RELEASE MEANS BETWEEN LIGHT GLOBE AND FIXTURE. Three evenly spaced, inwardly extending clips are provided about the fixture base rim, with the fixture cover or globe having a conventional outwardly extending flange about its base. The fixture cover is merely pushed into place, whereupon the retaining clips snap past the fixture cover flange to capture the flange within the fixture base. The cover is removed by turning in either direction, whereupon cams formed in the outer wall of the cover adjacent the flange, force the clips radially outwardly to allow the cover to be withdrawn. The arrangement provides some benefits over the conventional radially disposed screw retention method, but still allows a gap between the cover and base. Moreover, the loss or breakage of a single clip renders the assembly unusable. Also, if the cover is misaligned with the base by having the cams aligned with the clips, the cover will not be secured to the base, and no means is provided to determine this.

U.S. Pat. No. 4,520,435

U.S. Pat. No. 4,520,435 issued on May 28, 1985 to Samuel L. Baldwin describes an ORIENTABLE REFRACTOR MOUNTING, with a three-piece arrangement. The fixture base accepts an adapter ring by means of a bayonet type mount, with a fixture cover having a snap fit to the adapter ring. The fixture cover may be turned relative to the adapter ring to orient the light output, as the cover is not threaded to the ring. The arrangement is essentially a continuous circumferential clip arrangement, and thus more closely related to the Zapolsky and Valpey devices than to the present invention.

U.S. Pat. No. 5,263,788

U.S. Pat. No. 5,263,788 issued on Nov. 23, 1993 to Walter Moriel describes a FASTENING DEVICE FOR A BODY, comprising a plurality of radial tabs that engage corresponding slots in the body. A ring is provided within the tabs, which may be moved axially to hold the tabs in their engaged position. While the Moriel disclosure notes that the apparatus may be used to secure a transparent body to another object, it is not clear whether or not he is referring to a cover for a light. The Moriel apparatus is apparently directed to a means of permanently securing a solid body (i.e., chandelier pendant) to the mounting point, and no means is apparent for accessing the locking ring for later removal of the body. No helically disposed fastening means is disclosed, as provided by the present attachment system.

U.S. Pat. No. 5,309,342

U.S. Pat. No. 5,309,342 issued on May 3, 1994 to James J. Heinen, Sr. describes a RECESSED LIGHTING FIXTURE incorporating a circular peripheral frame that holds a circular translucent plate for a flush mounted lighting fixture. The frame includes a plurality of tabs extending upwardly therefrom, which engage corresponding slots in the fixture body or reflector. The assembly provides for ease of removal and reinstallation of the cover relative to the base, but due to the fact that the cover frame will drop downwardly slightly when completely engaged with the base, due to the depending fingers of the tabs, the cover cannot seal tightly against the base to preclude the entry of insects and other small animals therein. This gap between cover and base is apparent in FIG. 7 of the Heinen, Sr. patent.

U.S. Pat. No. 5,491,618

U.S. Pat. No. 5,491,618 issued on Feb. 13, 1996 to Usman Vakil describes a LIGHT FIXTURE having a cover with an outwardly extending flange with three gaps formed therein. The gaps correspond to inwardly facing projections formed in the fixture base. The gaps of the cover are aligned with the protrusions of the base and turned, so the cover flange rides over the protrusions of the base. The flange appears to be planar, rather than helical, so no tightening action occurs as the cover is progressively turned onto the base, as in the present light fixture cover attachment.

U.S. Pat. No. 5,738,437

U.S. Pat. No. 5,738,437 describes British Patent Publication No. 864,913 published on Apr. 12, 1961 to Robbins & Bradley Ltd. describes IMPROVEMENTS IN ELECTRIC LIGHT FITTINGS, wherein a plurality of pivotable retainers is secured to the fixture base. A cover having an inwardly extending flange is pressed into position, and the edge contacts a finger on each of the retainers, causing the retainers to pivot outwardly to support the flange of the cover. The arrangement is relatively complex, with its numerous moving parts and spring means to hold the retainers in position, and no turning engagement is disclosed.

U.S. Pat. No. 5,738,437 describes British Patent Publication No. 1,128,189 published on Sep. 25, 1968 to Phillips Electronic and Associated Industries Ltd. describes IMPROVEMENTS IN OR RELATING TO DEVICES FOR CENTERING ELEMENTS OF AN OPTICAL SYSTEM. The apparatus serves to fix a projector lamp magnetically within a reflector, and uses radically disposed screws to lock the alignment, as is known in the art.

Finally, U.S. Pat. No. 5,738,437 issued on Apr. 14, 1998 to Ilagan describes improvements to all of the above listed light cover attachment systems but, still uses flanges and a mating helical channel attachment. It includes an outwardly extending helical flange around the base of the cover and a mating helical channel within the light fixture base. Preferably, the flange and channel each form only a single pitch and extend around their respective components only 360 degrees, thereby allowing the fixture cover to be removed from or installed upon the fixture base with only a single turn.

None of the above inventions and patents, either singly or in combination, is seen to describe the instant invention as claimed.

OBJECTIVES OF THE INVENTION

Accordingly, the objectives of the present invention are (among others) to circumvent the deficiencies in the prior art and affect the following objectives:

(1) It is therefore a primary object of the present invention to provide a selectively detachable light fixture cover including a sealing arrangement that allows for relatively easy attachment and detachment.

(2) Additionally, the selectively detachable light fixture cover will provide needed protection for external wall mounted or any up facing incandescent or fluorescent lighting fixture from water damage, bug infestation and chemical residue from sprinkler system water.

(3) Another object of the present invention is to provide a low cost, high production volume light fixture cover made from a resilient material.

(4) Another object of the present invention is to provide a low cost disposable light fixture cover.

(5) Another object of the present invention is to provide a covering means for flood lighting fixtures that have industry standard diameters.

(6) Still another object of the present invention is to provide a light fixture cover including a structurally reinforced tab that makes the cover readily removable.

(7) Yet another object of the present invention is to provide a flared tab member that attaches to a relatively large portion of the light fixture cover's external surface thereby spreading the separation force over a wide range of the sealing area adjacent to the tab.

(8) Still another object of the present invention is to provide a reinforced tab member that resists bending at the point of attachment to the light fixture cover and allows for the direct transfer of separation forces from the tab member to the sealing region.

(9) Another object of the present invention is to provide ventilation holes in the cover to permit effective heat transfer while preventing water and insects from penetrating the light fixture cover barrier and contaminating the lamp enclosure.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

The present invention system is generally illustrated in FIGS. 2–7, and the present invention method is generally illustrated in FIG. 8. These will now be briefly described.

The present invention is essentially a low cost snap-on light fixture cover that permits enclosure of the light fixture without the need for retaining hardware or other structures. As illustrated in FIG. 2-7, the exemplary embodiments of the present invention make use of a retaining lip (0201) and installation/removal tab (0204) to permit the lamp cover to be applied to and removed from the lamp fixture much as a resealable lid is installed/removed from a food packaging container as illustrated in FIG. 1 (0106).

The light fixture covers of the present invention can be economically thermo-formed from any one of a number of known thermoplastic resins including but not limited to polyamides, polyacrylics, polyarylates, polycarbonates, polyesters, polyetherimides, polyetherketones, polyolefins, polyphenylenes, polyvinylchlorides, and various styrene and liquid crystal polymers, among others.

As illustrated in FIG. 8 (0800), the present invention system may be integrated into an application method that permits the fast and efficient installation and/or replacement of a lamp fixture cover with no tools being required. The low cost of the present invention system embodiments permits the creation of disposable lamp fixture covers that may be customized for a wide variety of visual effects, special lighting effects, or special events themes.

The various features, objects and advantages of the present invention should become still more apparent from a review of the following description of the drawings and invention in detail.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
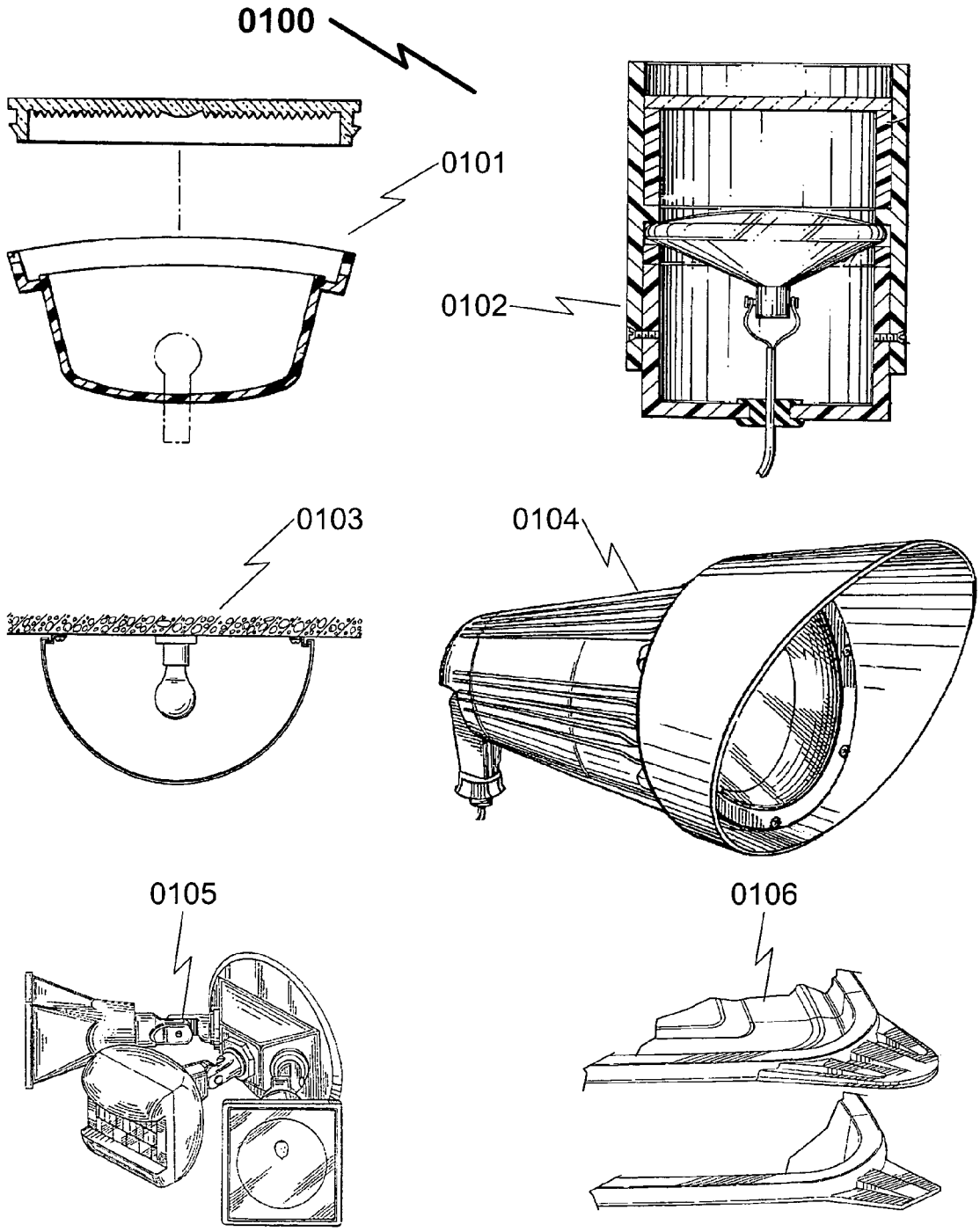
FIG. 1 illustrates a variety of prior art relevant to the problem solved by the present invention.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a LIGHT FIXTURE COVER SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Exemplary System Embodiment (0200, 0300, 0400, 0500)

The present invention comprises various embodiments of a transparent or translucent light fixture cover and the cover having mating attachment means devoid of any and all other fasteners, clips, retainers, etc. Conventional light fixtures include a plurality of threaded holes evenly spaced about the rim of the fixture base, with screws being driven through each of the holes to clamp the edge of the fixture cover. While this system has served to secure light fixture covers to their fixture bases since before the manufacture of circular fixtures and covers, the clamp screw method, with its numerous disadvantages, has generally been carried over to the present day, as shown in the prior art FIG. 1 (0104), with the exception of various clips and clamps which have been devised for the purpose.

Figure 2:
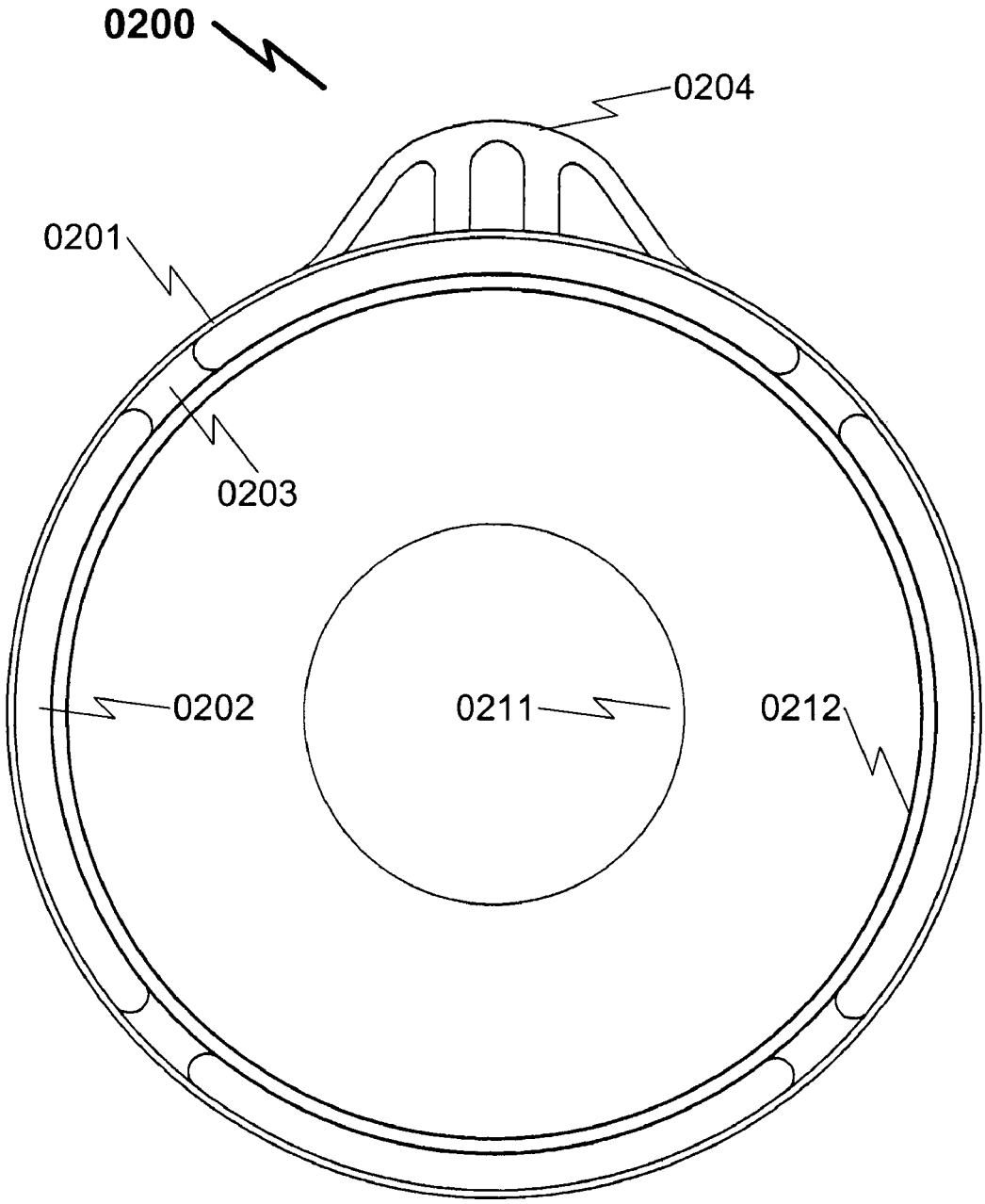
FIG. 2 illustrates a top view of a presently preferred embodiment of the present invention.
Figure 3:
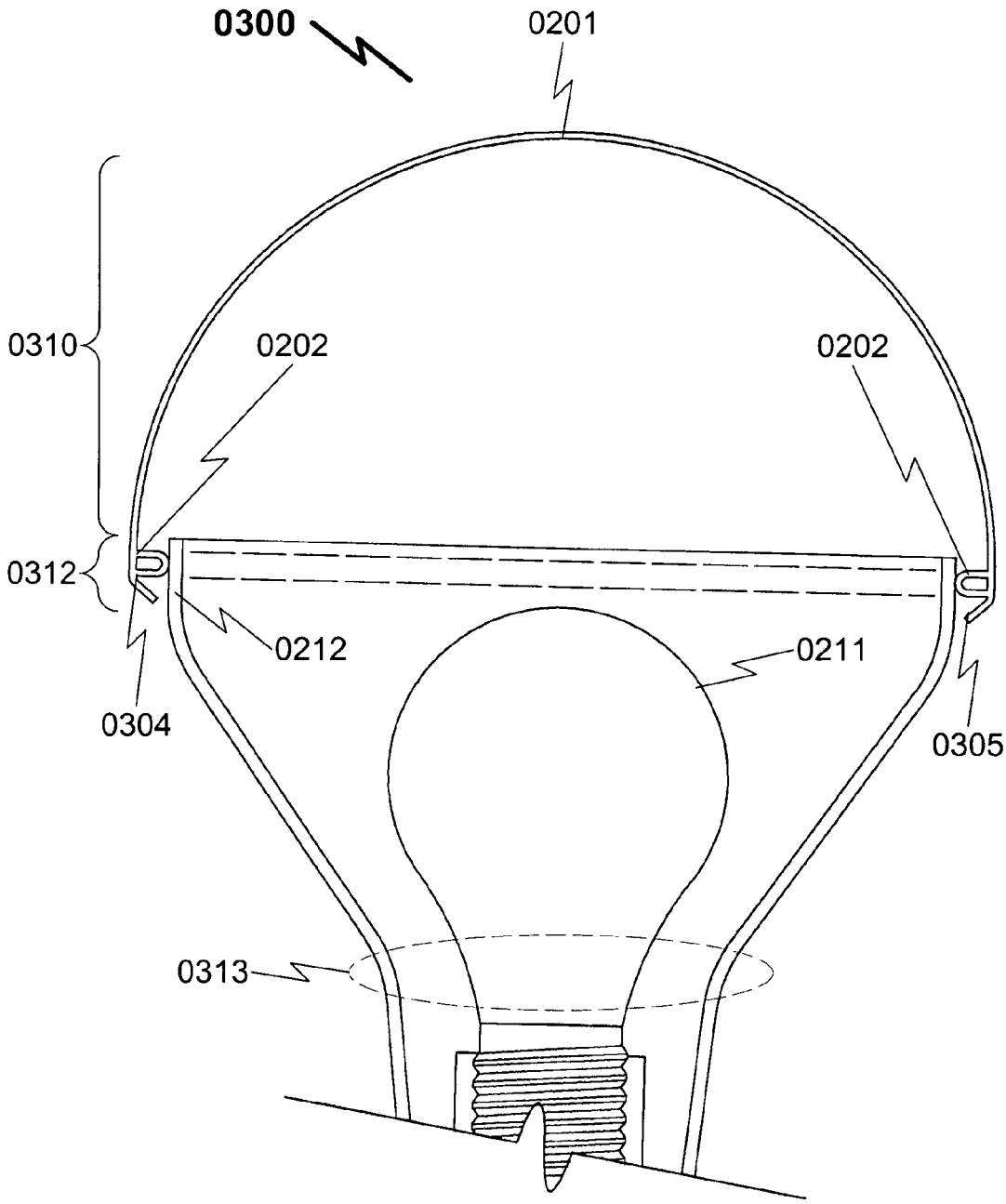
FIG. 3 illustrates a first side view of a presently preferred embodiment of the present invention.
Figure 4:
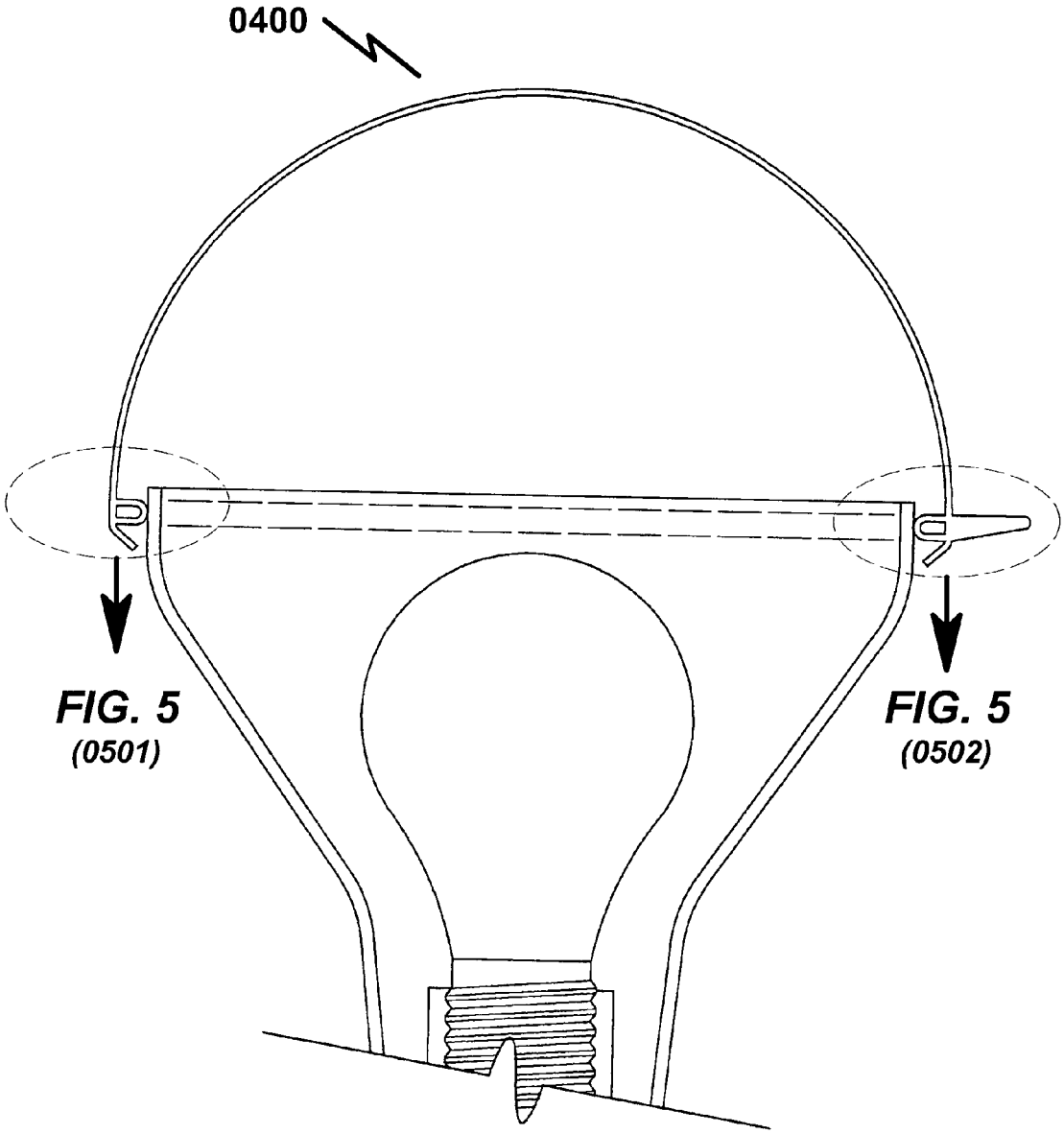
FIG. 4 illustrates a second side view of a presently preferred embodiment of the present invention.

In contrast, the basic formulation of the present invention is illustrated generally in FIG. 2 (0200), FIG. 3 (0300), and FIG. 4 (0400). These views (0200, 0300, 0400) will now be discussed in terms of the teachings of the present invention.

FIG. 2 (0200) illustrates a top view of the present invention, incorporating an outer lamp cover (0201), outer sealing lip (0202), plethora of venting/drainage channels (0203), and optional installation/removal tab (0204). These features permit enclosure of a lamp (0211) that is mounted in the lamp fixture base and surrounded by the outer rim (0212).

FIG. 3 (0300) provides an exploded perspective view of the present light fixture assembly, with its light fixture cover (0201) and light fixture base (0212). Rather than using screws, clips, clamps, and/or other hardware to secure the two components together, the cover (0201) is provided with an outwardly extending flange (0202) from its edge (0304). The channel (FIG. 2, (0203)) extending outwardly from the light fixture rim (0212) permits drainage and air ventilation to occur with the lamp (0211) in the light fixture enclosure (0313). As the typical light fixture enclosure (0313) cover is cast or otherwise formed of plastic or glass, the flange (0202) (and other flange embodiments described further below) may be formed integrally with the cover, as a single unitary article. The fixture base may include the channel (0203) integrally formed in a like manner, particularly for fixture bases cast of plastic material. The lamp cover (0201) may optionally include a deflected rim (0305) to further limit encroachment of water and contamination into the lamp enclosure (0313).

FIG. 4 (0400) provides another side view of a presently preferred embodiment of the present invention. Here the detail includes illustrations of the sealing lip and installation/removal tab that are further detailed in FIG. 5 as (0501) and (0502) respectively.

In summary, the present invention teaches an attachment means for a light fixture cover to a light fixture providing a much simpler and easier means of securing a lamp fixture cover to any fixture base. The press fit thermoplastic resin cover is a neat, clean, and inexpensive protective cover for external lighting fixtures.

Thus, the present attachment system serves to overcome the numerous deficiencies of the prior art attachment systems. The present cover and attachment system is economical to manufacture, easy to attach and remove, and provides a tight, secure fit between fixture cover and the external fixture base, to prolong the life of the light element and maintain cleanliness.

It is to be understood that the present invention is not limited to the sole embodiment described above, but encompasses any and all embodiments within the scope of the aforementioned claims.

System Variations (0600, 0700)

Figure 6:
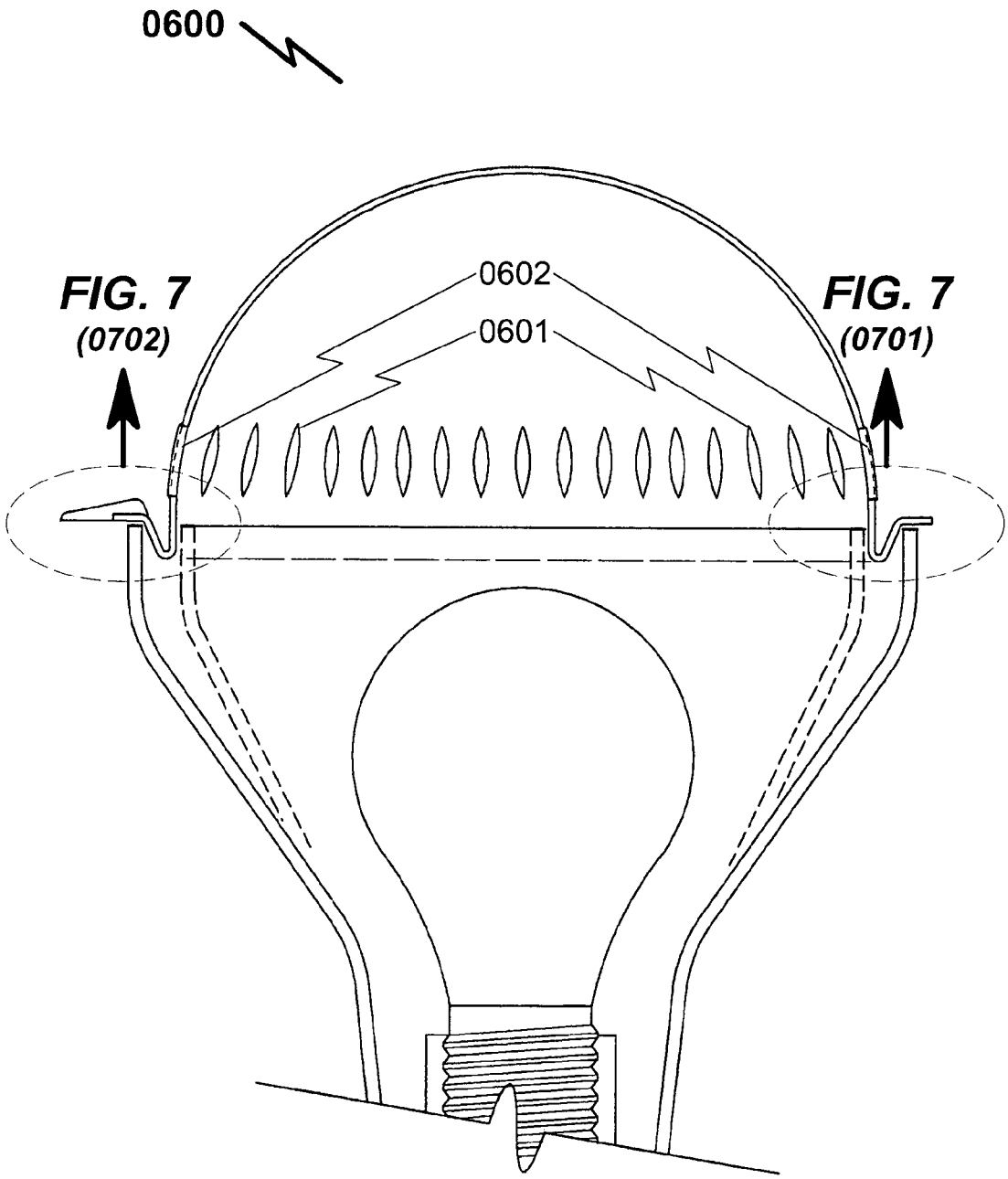
FIG. 6 illustrates a side view of a presently preferred alternate embodiment of the present invention.

FIG. 6 (0600) illustrates another sealing methodology consistent with the teachings of the present invention. Here the outer sealing mechanism and installation/removal tab are further detailed in FIG. 7 as (0701) and (0702) respectively. This configuration may be formed from sheet plastic and can accommodate inner and outer circumferences increasing the scope of the invention application base. In short, this configuration permits insertion INSIDE/INTO a lamp enclosure, as well as attachment to the OUTSIDE/OUT-OF of a larger lamp enclosure.

Note that this configuration additionally illustrates that optional ventilation holes (0601) may be included in the lamp cover to provide for heat transfer outside of the lamp enclosure while simultaneously preventing water, insects, and other contamination from entering the lamp enclosure. These ventilation holes (0601) may be formed by outward deformations (0602) caused by die perforations when cut from the lamp cover. This permits water to be directed around the ventilation opening. Note that while non-circular ventilation holes are illustrated, other shapes are possible, including circular holes.

Additionally, note that while the illustrated lamp fixture in the illustrations of FIGS. 2–7 is circular with a lamp fixture cover being hemispherical or generally convex, other lamp fixtures are anticipated, including rectangular and/or square fixtures. While these structures (as generally illustrated in FIG. 1 (0105)) are not as widely used as circular lighting fixtures, the present invention anticipates their use, as well as the use of non-hemispherical lamp fixture covers.

The present invention anticipates a wide variety of variations in the basic theme of construction. The examples presented previously do not represent the entire scope of possible usages. They are meant to cite a few of the almost limitless possibilities.

Summary System Construction

By inspection of the exemplary embodiments illustrated in FIGS. 2–7, the present invention can be generally described as follows:

A lamp fixture cover, having a lamp fixture body (0310), generally hemispherical in shape (although other shapes such as rectangular are anticipated) to permit a reasonable distance between a lighting source (0211) and the surface of the body (0310);

a peripheral resealable lip (0312) conforming to the outer perimeter (0212) of a lamp fixture and attached to the generally hemispherical outer boundary of the lamp fixture body (0201);

an installation/removal tab (0204) permitting manual installation/removal of the lamp fixture cover over the rim of an existing lamp fixture;

optional channel (0203) and deflection rim (0305) to provide ventilation and drainage of water.

Figure 5:
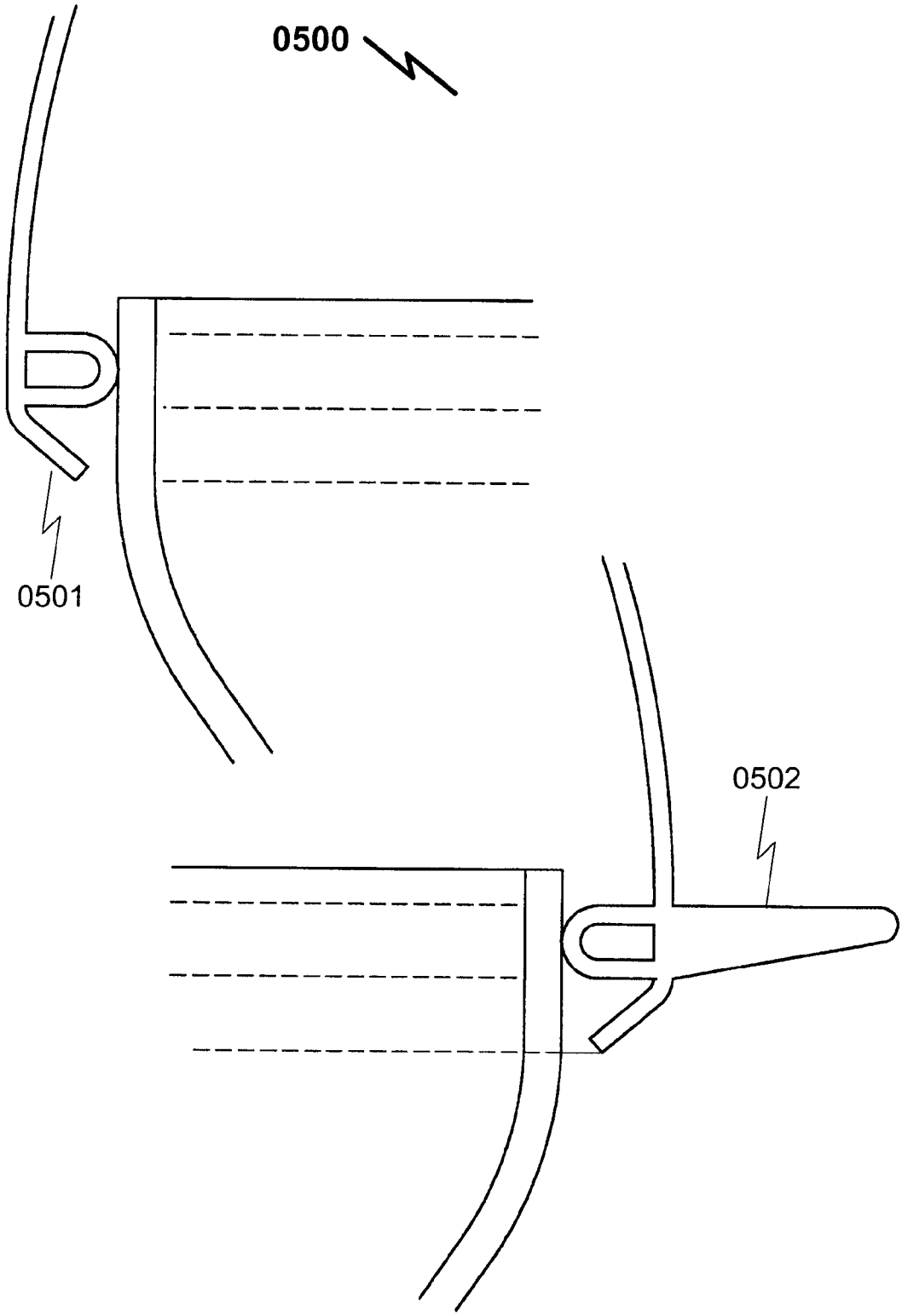
FIG. 5 illustrates a detailed side view of a lip sealing mechanism applicable to some presently preferred embodiments of the present invention.
Figure 7:
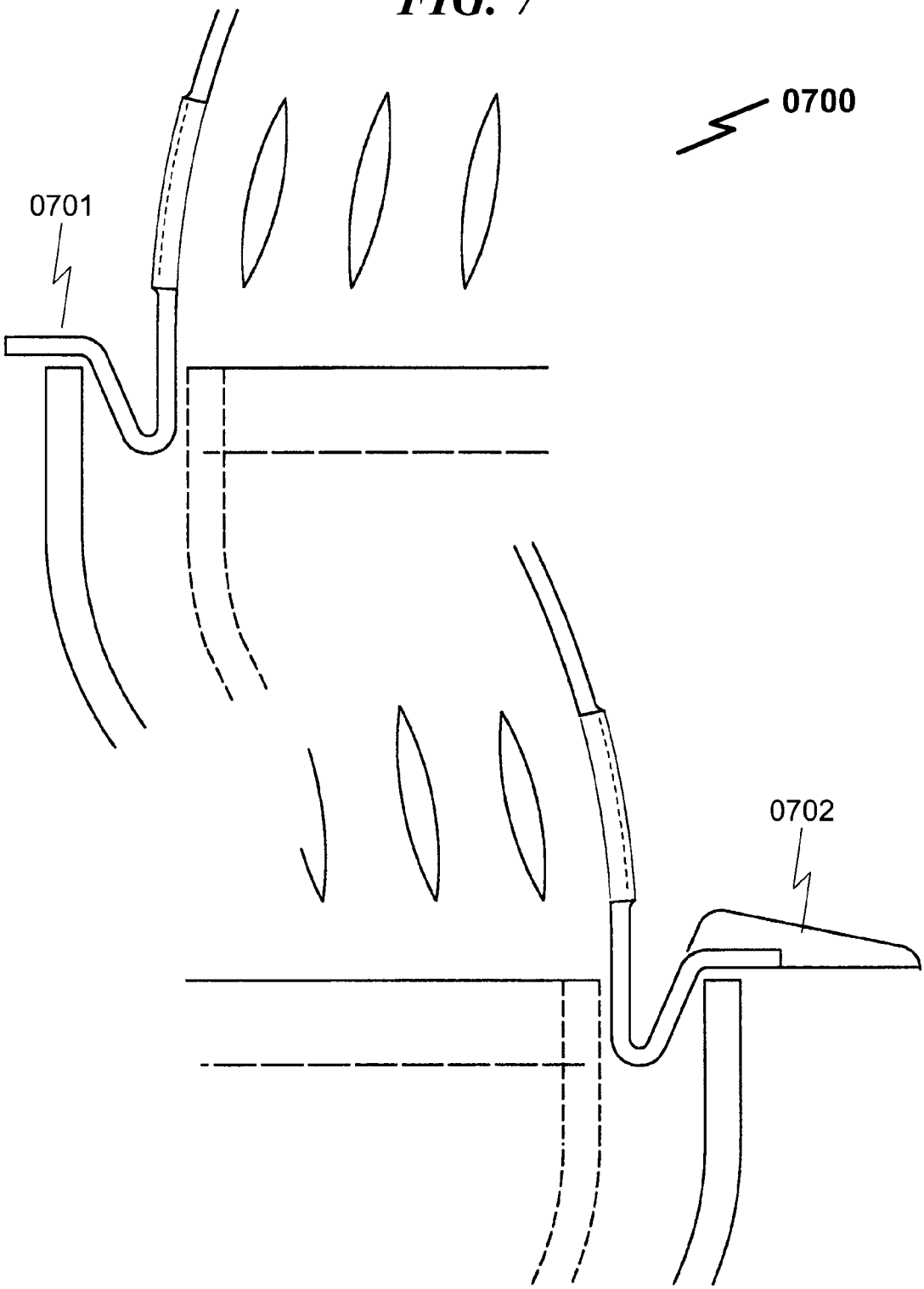
FIG. 7 illustrates a detailed side view of an alternate lip sealing mechanism applicable to some presently preferred embodiments of the present invention.

These basic designs may be augmented with a variety of sealing methods and installation/removal tabs detailed in FIG. 5 (0501, 0502) and FIG. 7 (0701, 0702).

Exemplary Method Embodiment (0800)

Figure 8:
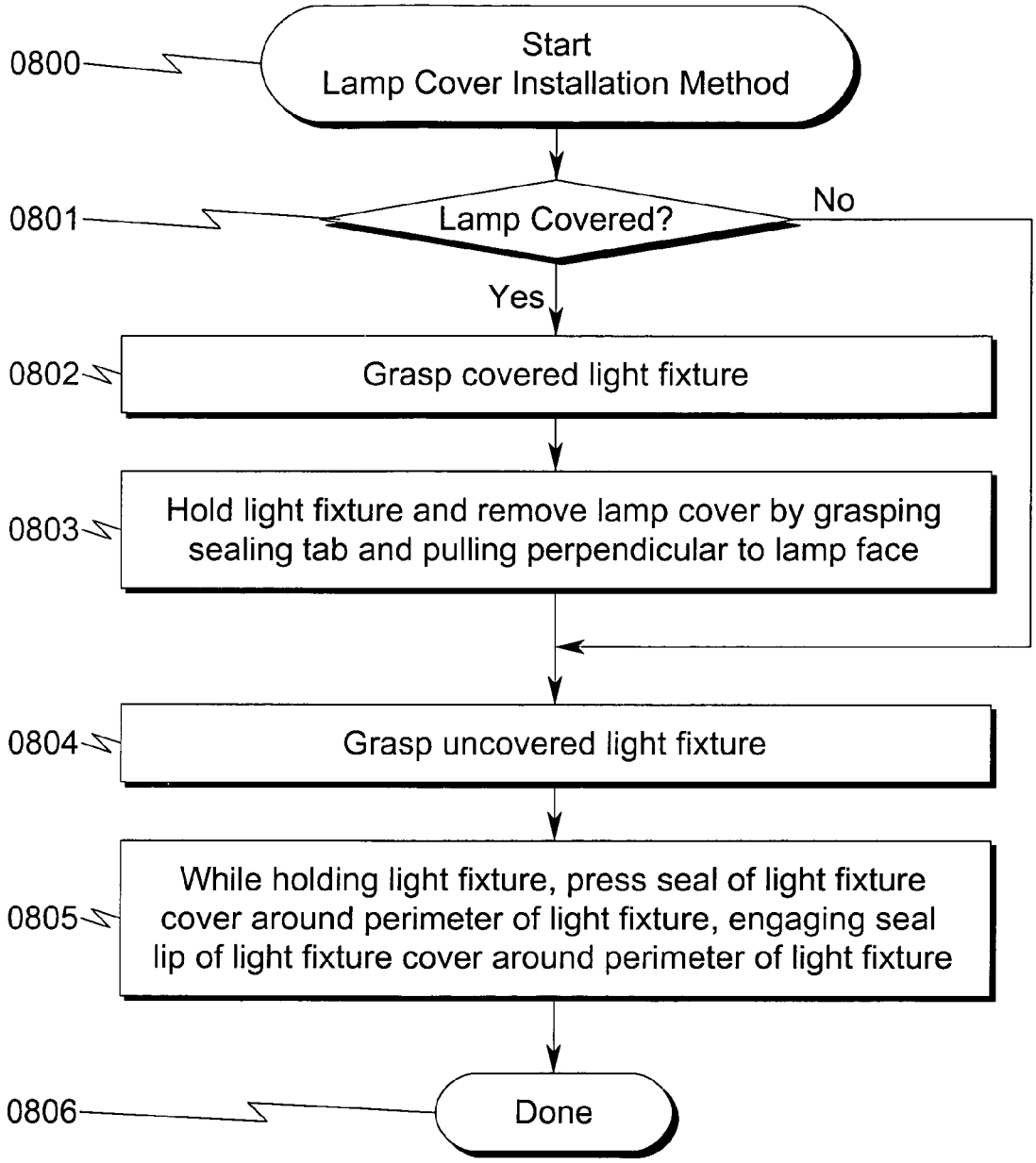
FIG. 8 illustrates an exemplary method using the teachings of the present invention.
Figure 9:
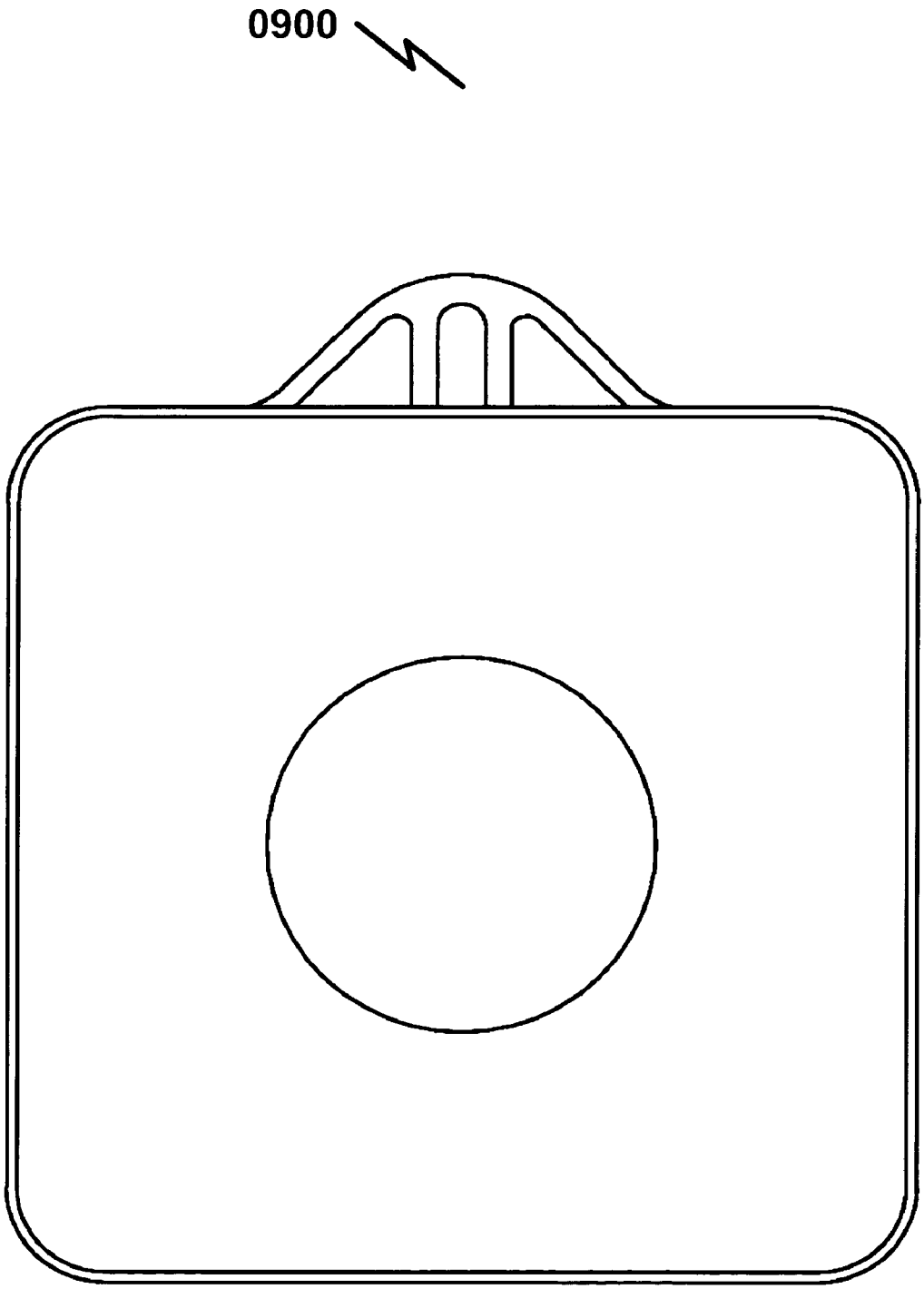
FIG. 9 illustrates a top view of an preferred exemplary embodiment of the present invention employing a lamp fixture body, generally convex in shape, having a generally rectangular outer boundary.
Figure 10:
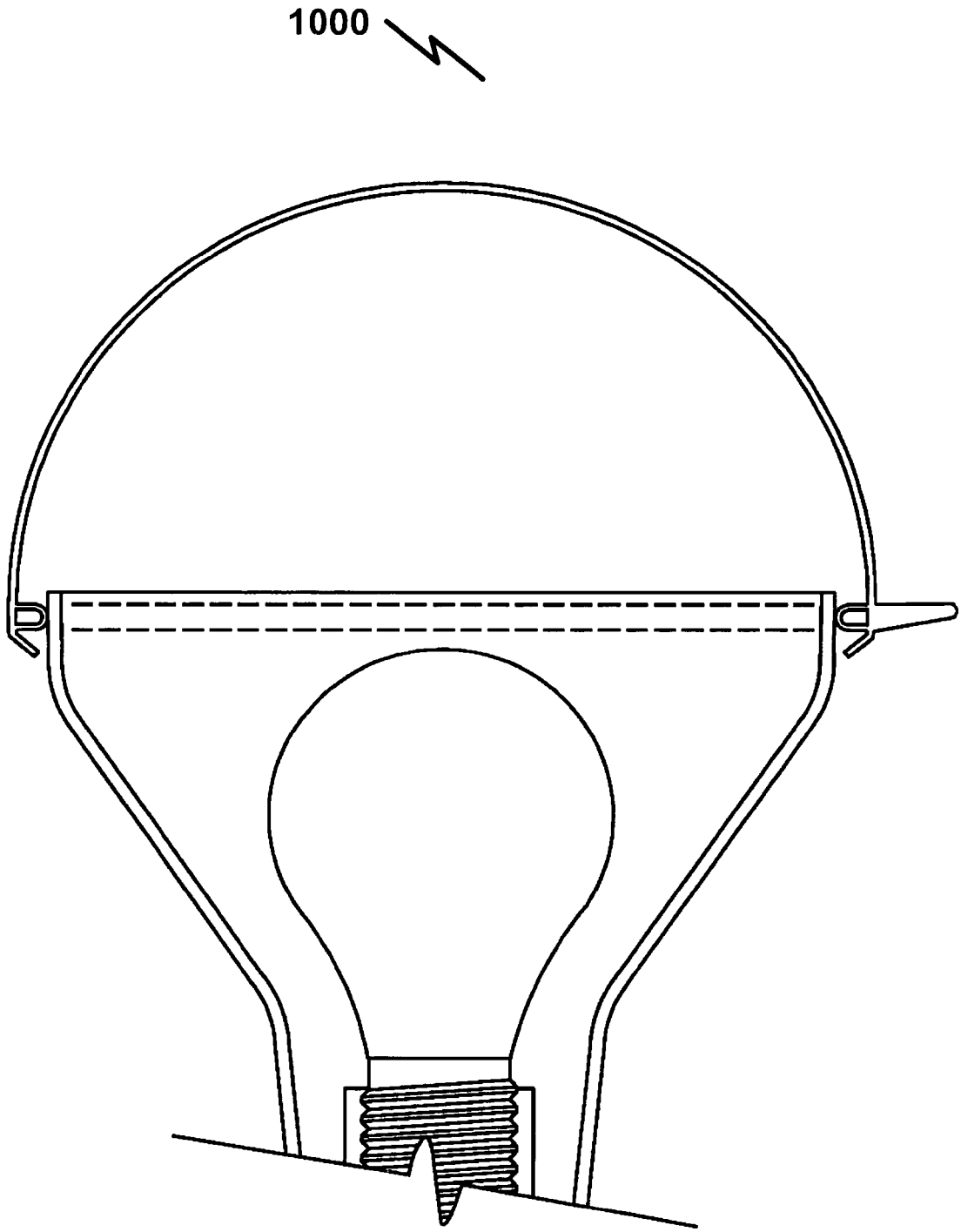
FIG. 10 illustrates a side view of a preferred exemplary embodiment of the present invention employing a lamp fixture body, generally convex in shape, having a generally rectangular outer boundary.

The general installation method for the present invention is illustrated in FIG. 8 (0800) and generally includes the following steps:

1. Determine if the light fixture is covered, and if not, proceeding to step (4) (0801);
2. Grasping the covered light fixture (0802);
3. Holding the light fixture and remove the lamp cover by grasping the sealing tab and pulling perpendicular to the lamp face (0803);
4. Grasping the light fixture which is to be covered (0804);
5. While holding the light fixture, press the seal of the light fixture cover around the perimeter of the light fixture, engaging the seal lip of the light fixture cover around the perimeter of the light fixture (0805).

At the end of this procedure, water and/or insects will not be able to enter the light fixture, and the fixture will be protected from damage. One skilled in the art will recognize that this method may be easily modified to permit removal of lamp covers by reversing the steps of this process.

APPLICATION

While the present invention has wide application, one target market for the present invention is that of permitting disposable lamp covers to be both practical and economical. The use of plastics normally associated with food storage containers as illustrated in FIG. 1 (0106) greatly increases the potential of this application.

The prior art teaches that these plastics can be dyed to a variety of colors, permitting special lighting effects to be implemented with disposable lamp covers. This permits, for example, seasonal lighting effects, such as special lighting for Halloween, Christmas, Easter, parties, and the like. The use of clear, translucent, or dyed plastics in this application is anticipated by the present invention.

CONCLUSION

A light fixture cover system and method has been disclosed in which the selectively detachable cover is also a unitary structure including a body having a peripheral sealing lip that fits over any corresponding industry standard outside light fixture. From the outset, it should be noted that while the cover is illustrated generally as being of a round configuration, the cover may be of various other configurations such as rectangular, oval or square by way of non-limiting examples to fit all shapes of exterior light fixtures. The sealing lip of the cover has at least one laterally extending tab member to assist in removing the cover from the fixture. The cover portion is preferably made from a resilient polymeric material suitable for both winter and summer weather conditions in addition to being impervious to the heat generated by the electrical bulb or bulbs contained it the light fixture.

Preferred embodiments of the present cover provide a tight fit between the cover and fixture base, thus precluding entry of insects or water into the interior of the assembly. The cover is devoid of screws, clips, or any other components, and requires no tools or other equipment to install and remove the light cover to and from its corresponding light fixture base.

CLAIMS

Although a preferred embodiment of the present invention has been illustrated in the accompanying drawings and described in the foregoing detailed description, it will be understood that the invention is not limited to the embodiments disclosed, but is capable of numerous rearrangements, modifications, and substitutions without departing from the spirit of the invention as set forth and defined by the following claims:

What is claimed is:

1. A light fixture cover system comprising:

(a) a lamp fixture body, generally hemispherical in shape, having a generally circular outer boundary, permitting a spatial distance between a lighting source in a lamp fixture and the surface of said lamp fixture body;

(b) a peripheral resealable lip conforming to the outer perimeter of a lamp fixture and attached to said generally circular outer boundary of said lamp fixture body;

(c) an installation/removal tab attached to said peripheral resealable lip which permits manual installation/removal of said lamp fixture cover over the outer rim of said lamp fixture;

wherein said resealable lip grips the outer perimeter of said lamp fixture permitting attachment of said lamp fixture cover to said lamp fixture;

said lamp fixture cover is constructed of a thermoplastic resin.

2. The light fixture cover system of claim 1 wherein said resealable lip conforms to the inner peripheral surface of said lamp fixture.

3. The light fixture cover system of claim 1 wherein said resealable lip conforms to the outer peripheral surface of said lamp fixture.

4. The light fixture cover system of claim 1 wherein said resealable lip includes a plethora of drainage channels located within the periphery of said resealable lip.

5. The light fixture cover system of claim 1 wherein said lamp fixture body includes a plethora of ventilation holes located proximal to the periphery of said resealable lip.

6. The light fixture cover system of claim 1 wherein said lamp fixture body includes a plethora of oblong ventilation holes located proximal to the periphery of said resealable lip.

7. The light fixture cover system of claim 1 wherein said lamp fixture body includes a plethora of circular ventilation holes located proximal to the periphery of said resealable lip.

8. The light fixture cover system of claim 1 wherein said thermoplastic resin is clear.

9. The light fixture cover system of claim 1 wherein said thermoplastic resin is translucent.

10. The light fixture cover system of claim 1 wherein said thermoplastic resin is dyed to permit coloration of light from said lamp fixture.

11. A light fixture cover system comprising:

(a) a lamp fixture body, generally convex in shape, having a generally rectangular outer boundary, permitting a spatial distance between a lighting source in a lamp fixture and the surface of said lamp fixture body;

(b) a peripheral resealable lip conforming to the outer perimeter of a lamp fixture and attached to said generally rectangular outer boundary of said lamp fixture body;

(c) an installation/removal tab attached to said peripheral resealable lip which permits manual installation/removal of said lamp fixture cover over the outer rim of said lamp fixture;

wherein said resealable lip grips the outer perimeter of said lamp fixture permitting attachment of said lamp fixture cover to said lamp fixture;

said lamp fixture cover is constructed of a thermoplastic resin.

12. The light fixture cover system of claim 11 wherein said resealable lip conforms to the inner peripheral surface of said lamp fixture.

13. The light fixture cover system of claim 11 wherein said resealable lip conforms to the outer peripheral surface of said lamp fixture.

14. The light fixture cover system of claim 11 wherein said resealable lip includes a plethora of drainage channels located within the periphery of said resealable lip.

15. The light fixture cover system of claim 11 wherein said lamp fixture body includes a plethora of ventilation holes located proximal to the periphery of said resealable lip.

16. The light fixture cover system of claim 11 wherein said lamp fixture body includes a plethora of oblong ventilation holes located proximal to the periphery of said resealable lip.

17. The light fixture cover system of claim 11 wherein said lamp fixture body includes a plethora of circular ventilation holes located proximal to the periphery of said resealable lip.

18. The light fixture cover system of claim 11 wherein said thermoplastic resin is clear.

19. The light fixture cover system of claim 11 wherein said thermoplastic resin is translucent.

20. The light fixture cover system of claim 11 wherein said thermoplastic resin is dyed to permit coloration of light from said lamp fixture.

21. A light fixture covering method comprising:

(1) determining if the light fixture to be covered is already covered, and if not, proceeding to step (4);

(2) grasping said covered light fixture;

(3) holding said covered light fixture and removing the lamp cover covering said covered light fixture by grasping the sealing tab of said light fixture cover and pulling perpendicular to the lamp face of said light fixture;

(4) grasping said light fixture which is to be covered;

(5) while holding said light fixture to be covered, pressing the seal of a light fixture cover around the perimeter of said light fixture to be covered, engaging the seal lip of said light fixture cover around the perimeter of said light fixture to be covered.

* * * * *